United States Patent [19]

Botting

[11] 3,977,448

[45] Aug. 31, 1976

[54] METHOD AND APPARATUS FOR STORING AND RELEASING A MARINE ANCHOR LINE AND ANCHOR

[76] Inventor: Donald P. Botting, 7756 Thornapple Bayou Drive, Grand Rapids, Mich. 49508

[22] Filed: May 7, 1975

[21] Appl. No.: 575,257

[52] U.S. Cl. ..... 114/210; 150/11

[51] Int. Cl.[2] ..... B63B 21/22

[58] Field of Search ..... 114/206 R, 210; 150/1, 150/11; 206/389, 409, 410; 9/14

[56] References Cited

UNITED STATES PATENTS

| | | | |
|---|---|---|---|
| 926,448 | 6/1909 | Wettstein | 280/187 |
| 1,148,924 | 8/1915 | Paradise | 150/11 |
| 2,192,203 | 3/1940 | Purdy | 9/14 |
| 2,236,383 | 3/1941 | Russell | 206/47 |
| 2,462,215 | 2/1949 | Norman et al. | 5/341 |
| 2,616,467 | 11/1952 | Cicero | 150/1 |
| 3,317,936 | 5/1967 | Johnson et al. | 9/14 |
| 3,375,918 | 4/1968 | Platky | 206/56 |
| 3,556,293 | 1/1971 | Schlueter | 206/56 |
| 3,676,882 | 7/1972 | Lindqvist | 9/14 |
| 3,754,525 | 8/1973 | Leighty | 114/206 R |
| 3,771,487 | 11/1973 | McGee, Jr. | 114/210 |

FOREIGN PATENTS OR APPLICATIONS

| | | | |
|---|---|---|---|
| 1,009,624 | 2/1950 | France | 150/11 |

*Primary Examiner*—Duane A. Reger
*Assistant Examiner*—Sherman D. Basinger
*Attorney, Agent, or Firm*—Price, Heneveld, Huizenga & Cooper

[57] ABSTRACT

A method and apparatus for storing, transporting, and dispensing a marine anchor and anchor line therefor. A storage container is included with opposing ends, one end having an aperture with the bitter end of the anchor line projecting therethrough for attachment to a vessel, while the anchor end of the line extends through an opening in the opposite end. The remainder of the line and any anchor are stored within the container. Structure at the opening is included for controlling release of the line. The container is secured along the anchor line to prevent its movement during such release and to prevent the bitter end from slipping back into the container. Structure for draining the container and carrying the container, anchor line, and anchor as a unit is included.

28 Claims, 7 Drawing Figures

METHOD AND APPARATUS FOR STORING AND RELEASING A MARINE ANCHOR LINE AND ANCHOR

BACKGROUND OF THE INVENTION

This invention relates to a method and apparatus for storing, transporting, and releasing a marine anchor and anchor line and, more particularly, to a method and apparatus which greatly simplifies the storage, transportation, and dispensing of such a line and anchor.

It is common in most boats and other marine vessels to carry at least one portable anchor for both planned and emergency use. Although larger ships, boats, and yachts typically have built-in facilities for storing their main anchors and anchor lines, such larger yachts also typically require at least one additional portable anchor and line. The principal problems involved in using such portable anchors are that the anchor and/or anchor line attached thereto is difficult to handle and move, the anchor line is subject to frustrating and dangerous snarls and tangles unless stored with the utmost care; and the bitter end of the anchor line, i.e., the end which is secured to the boat or yacht, is often difficult to locate and separate from the remainder of the anchor line regardless of whether the line is tangled or not.

One of the well-known methods for storing and transporting a portable anchor line and anchor include simply coiling the anchor line. However, coiling does not prevent disorder and tangles in the line, does not help locate the bitter end of the line, and does not facilitate release of the line when the anchor is thrown out. Coiled line also is difficult to transport and store with a heavy anchor or chain attached. Storing and transporting without the anchor attached necessitates removal and reconnection of the anchor.

Alternately, the anchor line can be stored and transported in a rigid or semi-rigid bucket or bag in an attempt to prevent tangles and snarls. However, conventionally known buckets cannot hold the anchor attached to the line, and the anchor, therefore, must be removed after use and reconnected for reuse. Further, the bucket is subject to tipping and spilling, and the bitter end of the line remains covered, unexposed, and unavailable necessitating removal of the line from the bucket prior to its attachment to the vessel. Finally, conventionally known buckets do not facilitate the release of the line at a gradual rate without an operator standing by and paying out the line by hand.

SUMMARY OF THE INVENTION

Accordingly, it is an object and purpose of the present invention to provide a method and apparatus for storing, transporting, and dispensing or using portable marine anchors and anchor lines. The anchor line and anchor are stored in a unique container in a neat, orderly, compact manner in a constant state of readiness wherein the anchor remains attached to the anchor line. The anchor line is drained and ventilated during storage in order to maintain the line dry and rot free. The method and apparatus allow the anchor line and anchor to be easily transported while stored in a container and yet allow the bitter end of the anchor line to be easily located and secured to a vessel without removing the anchor line and anchor from the storage container. Securement of the bitter end of the anchor line to the vessel prior to dispensing the anchor and line eliminates any chance of losing the anchor and line overboard. Moreover, the invention allows the anchor to be secured to the vessel directly by the anchor line, not indirectly via the container, without disengaging the line from the container. The container further pays the line out gradually without releasing the line all at once and reduces and/or prevents snarling and tangling by controlling release of the line without constant attention and operation by an operator.

In one aspect, the invention includes a container for receiving an anchor line and a marine anchor comprising side walls defining a storage area therewithin and first and second generally opposing ends. The first end is generally closed and includes an aperture to said storage area for receiving one end of an anchor line therethrough to secure the container to a vessel by mens of the anchor line. the second end includes an opening to the storage area for receiving the opposite end of the anchor line therethrough. A storage area is adapted to receive the intermediate section of the anchor line. Means for closing the opening at the second end are included having release means at the opening for engaging the anchor line when received therethrough and restraining and controlling release of the anchor line from the storage area to prevent the line from being released all at one time when the line is pulled outwardly from the container. Securing means are included for holding the container in a predetermined position along the anchor line when the line is pulled from the storage area.

In other aspects, the invention includes means for draining the storage area of the container, a handle for carrying the container, anchor line, and anchor as a complete assembly, and means for securing the anchor within the bag.

In another aspect of the invention, a method is defined for storing an anchor line for marine anchors with a container having a pair of ends, an aperture in one end, and an opening at the other end for inserting and removing the anchor line from the container. The method comprises projecting one end of the anchor line through the aperture is one end of the container for securing the container and line to a vessel by means of the anchor line. Further, the method includes arranging at least an intermediate portion of the anchor line in the container by inserting said portion into said container and projecting the other end of the said anchor line through said opening at the other container end for attachment to a marine anchor.

In other aspects, the method includes controlling release of the line through the opening with a control means at the opening, securing the container at a position along the length of the line, and storing at least a portion of an anchor in the container. Also included are securing the container to a portion of the anchor and draining and transporting the container, anchor, and line.

These and other objects, advantages, purposes, and features of the invention will become more apparent from a study of the following description taken in conjunction with the drawings.

DESCRIPTION OF THE PREFERRED EMBODIMENT

Figure 1:
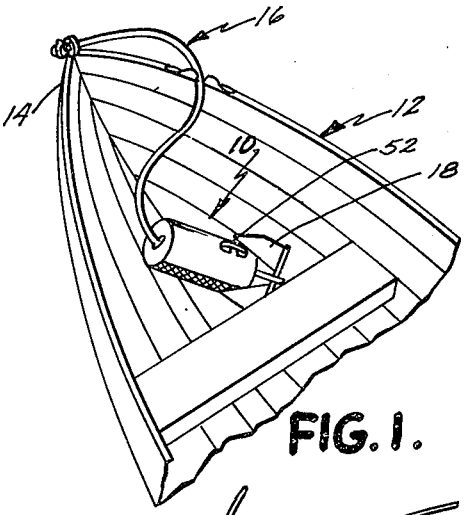
FIG. 1 is a fragmentary, perspective view of the container of the present invention including an anchor line and anchor with the bitter end of the anchor line extending from one end of the container and secured to the bow of a boat.

Referring now to the drawings in greater detail, FIG. 1 illustrates the container 10 of the present invention together with the anchor line and anchor as an assembly or unit. The assembly is secured to the bow 14 of a typical boat 12 directly by means of the same anchor line 16 which is stored in the container and attached to the anchor 18. As used herein, anchor line means any flexible connector such as a rope or chain. The illustrated anchor is of the Danforth type although virtually any portable anchor can be stored, transported, and dispensed using the invention. The anchor and anchor line need not be removed from the storage and transporting container 10 prior to attachment to the boat or vessel. The bitter end 16*a* of anchor line 16, which may include a preformed loop 17, projects through an end of the container and is readily available for such securement. The anchor end 16*b* of line 16 projects through an opening at the opposite end. Moreover, the anchor line and anchor are retained in a constant state of readiness in a dry, ventilated storage until required for use. During use, the anchor is released from the securing means holding it to the bag, thrown over the side of the boat while the container controls release of the line without attendance or attention by the boat operator to assure that the line is pulled gradually over the side of the boat not entirely at one time.

Figure 3:
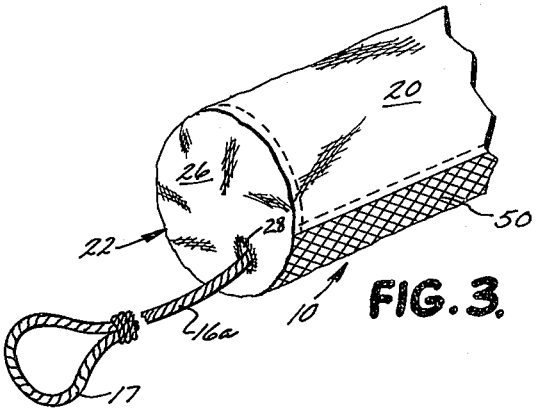
FIG. 3 is a fragmentary, perspective view of the closed end of the container with the bitter end of the anchor line extending through the aperture in the closed end.

As shown in FIGS. 2, 3, and 5–7, the container 10 comprises a bag formed from flexible, water-proof, woven fabric material including cotton, synthetic or other fibers and formed generally in the shape of a right, circular cylinder. The container or bag 10 includes side walls 20 defining an elongated, generally cylindrical storage area or space therewithin between a pair of opposing ends 22 and 24. Preferably, side walls 20 are formed from a rectangular piece of material sewn together into a cylinder. End 22 is generally closed by an end panel 26 sewn to the end edge of the cylindrical side walls 20 as shown in FIG. 3. An aperture 28 preferably approximating about twice the cross-sectional size or diameter of the anchor line 16 to be stored in the container extends through end panel 26 to provide a passageway from the storage area to the exterior of the bag. Making aperture 28 about twice the line size allows loop 17 to be passed therethrough. Since the end panel 26 is typically formed from fabric material, the edges of aperture 28 are sewn or otherwise reinforced to prevent fraying and ripping of the material.

Figure 5:
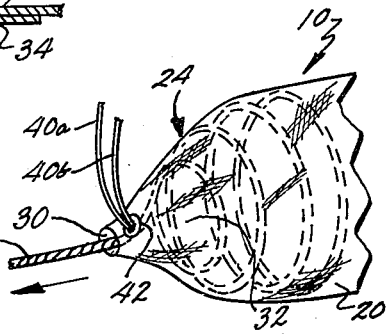
FIG. 5 is a fragmentary, perspective view of the release end of the container with its flexible release means closed around the anchor line.
Figure 6:
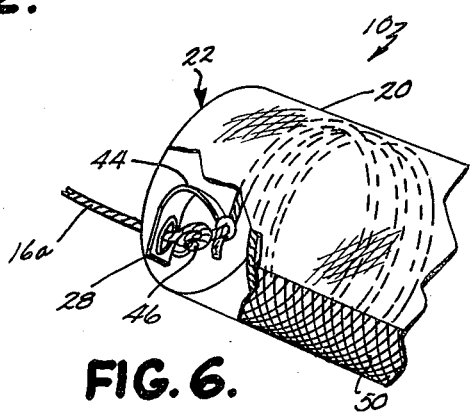
FIG. 6 is a fragmentary, perspective view of the container with portions broken away illustrating the securement of the container at a predetermined position along the anchor line.

The opposite end 24 of container 10 is provided with a mouth or opening 30 which may be adjusted and closed to a plurality of opening sizes between a large, open position (FIG. 2) and a smaller, generally closed position in which only a small opening is provided (FIG. 5). The maximum opening of mouth 30 is equal to the overall width dimension of the storage area within the side walls 20 of container 10. In the preferred embodiment, mouth 30 has a diameter equivalent to that of the circular cylindrical storage area. In its typical closed position, mouth 30 is closed down to a size approximating but slightly larger than the cross-sectional area of one thickness of the anchor line or the shank of an anchor adapted to be stored within the container although the opening can be closed even further to tightly grip the line.

Figure 2:
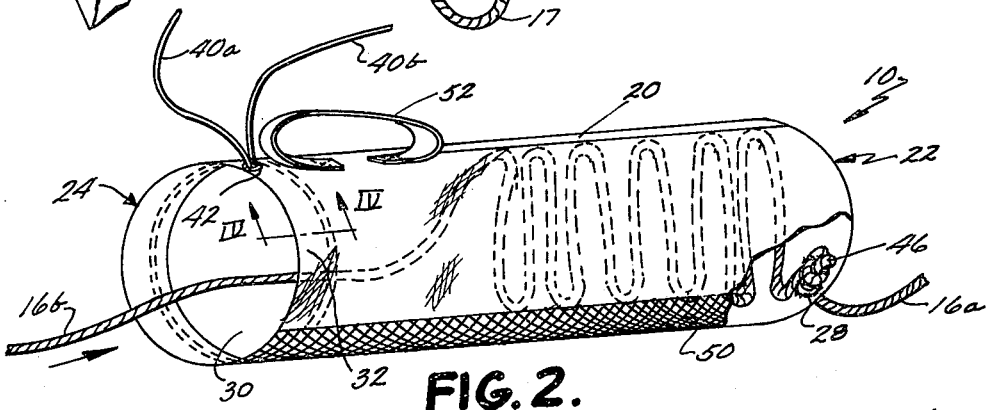
FIG. 2 is a perspective view of the container with portions broken away illustrating an anchor line stored therein.
Figure 4:
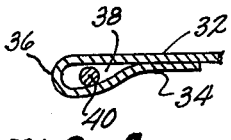
FIG. 4 is a fragmentary, sectional view of a portion of the release means at the open end of the container taken along plane IV—IV of FIG. 2.
Figure 7:
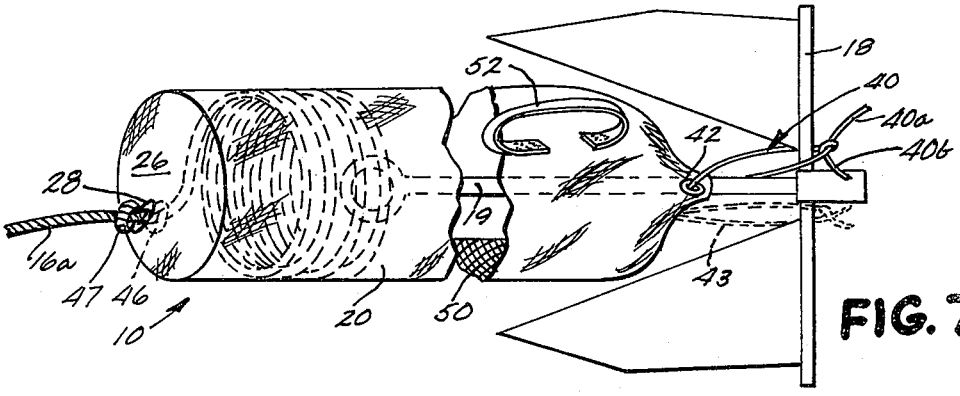
FIG. 7 is a broken, perspective view of the container illustrating the storage of both an anchor line and anchor therein.

A particular aspect of the invention, shown best in FIGS. 2, 5, and 7, is the releasing apparatus positioned at the opening 30 for restraining and controlling release of the anchor line from the storage area within the container when the anchor 18 is thrown over the side of a boat or the anchor line is otherwise pulled out of the storage area from the anchor end of the line. The preferred form of the release apparatus includes flexible side wall areas 32 completely surrounding the opening 30 and formed from flexible fabric as is the remainder of the container. The fabric or other flexible material is folded over upon itself inside the opening 30 as shown in FIG. 4 with the free end 34 of the material sewn or otherwise secured to a portion of the flexible sides 32 at a position spaced back from edge 36 of opening 30 to form a flexible, annular envelope 38.

Received within annular envelope 38 is an elongated, flexible drawstring or cord 40 which extends completely around the envelope 38 with its free ends 40*a* and 40*b* extending outwardly of an aperture 42 formed in the exterior of the envelope 38. In order to prevent fraying of the opening 42, a circular or other shaped metallic grommet is positioned around the edge of the opening. As will be more fully described below, the free ends 40*a* and 40*b* of cord 40 have sufficient length to be tied around a portion of the anchor 18 when it is positioned within the storage area of the container 10 to secure the anchor therein as shown in FIG. 7. Alternately, separate straps 43 (FIG. 7) or other securing means can be sewn to the bag to hold the anchor therein. By pulling on the ends 40*a*, 40*b* of drawstring 40, the adjustable release apparatus at mouth or opening 30 is reduced in size and closed down to engage the anchor end of anchor line 16 which projects therethrough as shown in FIGS. 2 and 5. The cord or drawstring is tied to hold the opening 30 at the desired size as shown in FIG. 5. When the anchor is thrown overboard, the anchor line will be pulled outwardly by the anchor end of the line through the reduced size opening 30 thereby gradually releasing the line and preventing the entire mass or any large bundle or portion of the stored line from being pulled from the storage area at the same time, i.e., en masse.

In order to hold the container 10 in position along the anchor line and to prevent the container from following the line overboard when the anchor 18 is cast outwardly from a boat and to prevent the bitter end 16*a* from slipping back into the container, the bag is secured along the length of the line in a predetermined position. In one form, a securing strap 44 (FIG. 6) is provided adjacent the inside aperture 28. Strap 44 is tied to a portion of the bitter end section 16*a* of the anchor line 16 to hold the bag in position. Preferably, strap 44 is sewn to the bottom of the bag and the aperture 28 cut through both the thickness of the strap 44 and the end panels 26 to reinforce aperture 28 and hold the strap 44 in place. Strap 44 also may be woven through the various filaments of the anchor line to provide a more secure fastening to the line.

Alternately, instead of strap 44 or together with that strap, a knot 46 is tied in the line 16 immediately adjacent the inside surface of end panel 26. A knot 47 may be tied in line 16 immediately adjacent the exterior of panel 26 and aperture 28 to keep the bitter end 16a from slipping back into the bag. The knot 46 engages the portions of the end panel 26 surrounding aperture 28 since aperture 28 is preferably sized to be about twice the normal diameter of the line. Accordingly, when securing strap 44 and/or knot 46 is used, bag 10 is restrained from movement along anchor line 16 toward the anchor end 16*b* of the line even though the engagement of line 16 with the opening 30 as it is pulled from the bag exerts a force which urges the bag along the line. Strap 44 and knot 46 resist such movement of the bag and maintain its position on the line and prevent the line from being pulled out of the bag through aperture 28. Thus, when anchor 18 is cast overboard, the line will be released gradually from the bag without attention by an operator and the bag will remain positioned within the boat on the anchor line. Use of knot 47 prevents the bitter end 16*a* from being lost within the bag.

A drainage panel 50 is positioned along one portion of the side walls 20 of bag 10 as shown in FIGS. 2, 3, 6, and 7. Drainage panel 50 is preferably formed from nylon or other synthetic fiber mesh material including a plurality of apertures therethrough. Panel 50 is an elongated rectangular strip of such material which preferably extends between ends 22 and 24 generally parallel to the axis of the cylindrical bag 10. The panel is sewn to the remaining fabric material and provides a means for draining water collected within the bag when wet anchor line is inserted and stored in the storage area of the bag. The panel further provides a ventilation means allowing air to enter the bag and dry the stored line even when it is placed therein in wet condition. Accordingly, bag 10 may be used to store all types of anchor line both synthetic and natural since the container allows the line to dry out while stored thereby preventing rot and mildew.

Preferably, the portions of the bag other than drainage panel 50 are formed from waterproof canvas fabric which sheds and resists absorption of water. The bag may be stored with the waterproof areas extending upwardly and the drainage panel downwardly even in an open boat such that any water splashed or rain falling into the boat will be shed from the bag while the drainage panel allows the line to dry out should any water enter the bag.

Sewn and positioned near the open end 24 is a flexible handle 52. Handle 52 is preferably positioned across the bag opposite to drainage panel 50 on the top portion of the bag. Handle 52 allows the bag to be carried with the drainage panel extending downwardly such that water will drain from the bag while being carried. Further, since the bag is preferably stored with the drainage panel facing downwardly, the handle will be in proper position to pick up the bag. Further, opening 42 is envelope 38 for drawstring 40 is also provided adjacent the handle at the top portion of the bag so that the size of opening 30 and the securement of the anchor within the bag can all be controlled from the top without movement of the bag.

METHOD

As shown in the several figures, the invention also comprises a method for storing, transporting, and dispensing an anchor line and a marine anchor. Preferably, the method is performed using a bag or container of the type described above and shown in the drawings.

As shown in the drawings, the bitter end 16a of anchor line 16 is projected through aperture 28 in the closed end of the bag 10. The bag is secured on that section of the line either by tying strap 44 around or through the line or by typing knots 46, 47 in the anchor line itself to prevent movement of the bag along the line, slippage of the line out of the bag, or slippage of bitter end 16*a* into the bag. It is noted that projecting of bitter end 16*a* may be made by inserting it first through opening 30, through the storage area within the bag and then outwardly through the aperture or vice versa by inserting anchor end 16*b* of line 16 through aperture 28, the storage area within the bag, and outwardly through opening 30. Typically, however, since anchor 18 will already be secured to the anchor line and include more bulky hardware such as a leader chain for securing the line to the anchor at the anchor end of the line, the bitter end will be inserted in the first-described manner since the anchor hardware would not otherwise pass through aperture 28.

Following securement of the bag to the bitter end 16*a* of line 16, the anchor line portion intermediate the ends is compactly layed in, inserted, or coiled and stored within the storage area of the bag beginning with the line portions immediately adjacent bitter end 16*a* as shown in FIGS. 2 and 5–7. The line is typically layed within the bag section by section or length by length in random fashion without inserting the line therein in a single bundle. After such insertion, the anchor end 16*b* of the line, either with or without the anchor attached thereto, extends outwardly through opening 30. Opening 30 may then be closed to a size approximating the diameter of the anchor line using drawstring 40 to close flexible sides 32 in the above-described manner such that the line will be in a state of readiness for casting the anchor overboard for release of the line without attention by the boat operator.

Alternately, when the anchor is attached to the anchor line, the anchor may also be stored in the container by inserting shank 19 of the anchor 18 (FIG. 7) into the storage area of the bag through opening 30 alongside the coiled or stored line. thereafter, the drawstring 40 is used to close opening 30 down about the shank 19. Either free ends 40*a*, 40*b* of cord 40 or securing straps 43 are thereafter used to tie around the end of the anchor to hold the anchor in place in the bag. Thus, when bitter end 16*a* is disengaged from the boat or vessel, the entire anchor line, anchor, and container may be carried as an assembly or unit and stored together. The container retains the anchor and line in a constant state of readiness with the bitter end exposed for immediate securement to a boat while storing the line in an orderly, compact fashion which prevents the line from becoming snarled or tangled.

When it is desired to use the anchor, the anchor line, anchor, and container assembly may be taken from its storage area and secured to the bow or other portion of the boat using the exposed bitter end 16*a* of anchor line 16. The anchor line directly secures the anchor to the boat for optimum securing strength. The bag itself is not relied upon to secure the anchor to the vessel.

After securing the assembly to the boat with the bitter end 16*a* of line 16, drawstring 40 is untied from the anchor and anchor shaft 19 is removed from the bag. The adjustable opening 30 is left in its closed-down, smaller-sized opening position in which the anchor was stored or adjusted to a desirable size. The free ends 40*a*, 40*b* of the drawstring are tied at aperture 42 to hold the opening 30 at that desired size. Accordingly, the small opening will approximately correspond to the cross-sectional size of anchor line 16 which projects through that opening. Thereafter, the anchor may be cast overboard in the conventional manner. The anchor line will follow the anchor, exiting from the bag at a gradual rate which is controlled by the engagement of the line with the release apparatus at opening 30 to prevent the line from being released all at one time and to help eliminate and/or prevent snarls and tangles in the line. The container 10 will remain in the boat and secured to the bitter end 16*a* of anchor line 16 by means of strap 44 or knot 46 and therefore will not follow the line overboard. Hence, release of the line is accomplished without attention by the boat operator.

In the stored condition with anchor line 16 and anchor 18 retained in the bag 10, the entire assembly may be carried by means of handled 52 with drainage panel 50 extending downwardly such that water resulting from storing a wet line in the bag will freely drain from the bag during such carrying. Further, drainage panel 50 allows the storage area to be well-ventilated for drying the line when stored in a wet condition.

Although the present method is described in connection with the preferred embodiment of the container described herein, it will be understood that the method may be performed using virtually any container having generally opposed ends with an aperture and opening provided therein and a means for securing the container to the line to prevent its following the line overboard when the anchor is cast from the boat and to prevent line from slipping out of or the bitter end from slipping into the container. Preferably, a line control means for releasing the line in the above-described manner by engaging the line to control and prevent exiting of the line all at one time will also be included.

While several forms of the invention have been shown and described, other forms will not be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. Storage, transportation, and dispensing apparatus for a marine anchor and anchor line comprising in combination:

an anchor line having an anchor end section adapted to be secured to a marine anchor and a bitter end section adapted to be secured to a vessel;

a container for receiving said anchor line;

said container including side walls defining a storage area therewithin receiving at least a portion of said line for storage therein and first and second generally opposing ends, said first end being generally closed and having an aperture therethrough, said aperture receiving therethrough said bitter end section of said anchor line to attach said apparatus to a vessel, said second end including an opening to said storage area receiving said anchor end section of said anchor line therethrough;

release means at said second end opening engaging said anchor line for restraining and controlling release of said anchor line from said storage area, said release means including means for changing the size of said second end opening to prevent a large bundle of said line from being released en masse when said line is pulled outwardly from said container; and securing means for holding said container in a predetermined position along said anchor line to prevent said container from moving with the anchor line toward said anchor end of said line and any anchor when said line is pulled from said storage area, to prevent said bitter end from slipping into said container, and to prevent said line from being released through said aperture.

2. The apparatus of claim 1 including drainage and ventilation means in one portion of said container for draining water or other liquids from said storage area and for allowing air circulation to said storage area to dry said anchor line.

3. The apparatus of claim 1 wherein said securing means include a knot tied in said anchor line and having a size larger than said aperture in said first end, said knot positioned interior of said first end to keep said container from moving toward said anchor end of said anchor line.

4. The apparatus of claim 3 including a second knot tied in said anchor line and having a size larger than said aperture in said first end, said second knot positioned exterior of said first end to prevent said bitter end from slipping back into said container and to prevent said line from being released from said container.

5. The apparatus of claim 1 wherein said bitter end of said anchor line, and thus said container, is secured to a vessel.

6. The apparatus of claim 1 including a flexible, mexh drainage and ventilation panel in one portion of said container for draining water or other liquids from said storage area and for ventilating said storage area to dry said anchor line.

7. Storage, transportation, and dispensing apparatus for a marine anchor and anchor line comprising in combination:

an anchor line having an anchor end section adapted to be secured to a marine anchor and a bitter end section adapted to be secured to a vessel;

a container for receiving said anchor line;

said container including side walls defining a storage area therewithin receiving at least a portion of said line for storage therein and first and second generally opposing ends, said first end being generally closed and having an aperture therethrough, said aperture receiving therethrough said bitter end section of said anchor line to attach said apparatus to a vessel, said second end including an opening to said storage area receiving said anchor end section of said anchor line therethrough;

means for closing said opening at said second end including release means at said opening engaging said anchor line for restraining and controlling release of said anchor line from said storage area to prevent a large bundle of said line from being released en masse when said line is pulled outwardly from said container;

securing means for holding said container in a predetermined position along said anchor line to prevent said container from moving with the anchor line and any anchor when said line is pulled from said storage area, to prevent said bitter end from slipping into said container, and to prevent said line from being released through said aperture; and drainage means for draining water or other liquids from said storage area including a flexible, mesh, drainage panel extending along one portion of said side walls between said first and second opposing ends of said container.

8. Storage, transportation, and dispensing apparatus for a marine anchor and anchor line comprising in combination:

an anchor line having an anchor end section adapted to be secured to a marine anchor and a bitter end section adapted to be secured to a vessel;

a container for receiving said anchor line;

said container including side walls defining a storage area therewithin receiving at least a portion of said line for storage therein and first and second generally opposing ends, said first end being generally closed and having an aperture therethrough, said aperture receiving therethrough said bitter end section of said anchor line to attach said apparatus to a vessel, said second end including an opening to said storage area receiving said anchor end section of said anchor line therethrough;

means for closing said opening at said second end including release means at said opening engaging said anchor line for restraining and controlling release of said anchor line from said storage area to prevent a large bundle of said line from being released en masse when said line is pulled outwardly from said container;

securing means for holding said container in a predetermined position along said anchor line to prevent said container from moving with the anchor line and any anchor when said line is pulled from said storage area, to prevent said bitter end from slipping into said container, and to prevent said line from being released through said aperture; and said release means including flexible portions of said side walls adjacent and extending around said opening and drawing means for drawing said flexible side wall portions together around said anchor line to engage said anchor line for controlled release thereof.

9. The apparatus of claim 8 wherein said drawing means includes an envelope formed in said flexible side wall portions and extending around the edge of said opening and an elongated, flexible drawstring extending through said envelope for drawing said envelope together.

10. The apparatus of claim 9 wherein said container is formed from flexible, fabric material and including a flexible, mesh, drainage panel extending along one portion of said side walls between said first and second opposing ends of said container.

11. The apparatus of claim 9 including a marine anchor secured to said anchor end of said anchor line, said anchor being at least partially inserted into said storage area through said opening in said second end, said drawstring having end portions extending from said envelope and tied around said anchor to retain it in said container for storage and transportation.

12. Storage, transportation, and dispensing apparatus for a marine anchor and anchor line comprising in combination:

an anchor line having an anchor end section adapted to be secured to a marine anchor and a bitter end section adapted to be secured to a vessel;

a container for receiving said anchor line;

said container including side walls defining a storage area therewithin receiving at least a portion of said line for storage therein and first and second generally opposing ends, said first end being generally closed and having an aperture therethrough, said aperture receiving therethrough said bitter end section of said anchor line to attach said apparatus to a vessel, said second end including an opening to said storage area receiving said anchor end section of said anchor line therethrough;

means for closing said opening at said second end including release means at said opening engaging said anchor line for restraining and controlling release of said anchor line from said storage area to prevent a large bundle of said line from being released en masse when said line is pulled outwardly from said container;

securing means for holding said container in a predetermined position along said anchor line to prevent said container from moving with the anchor line and any anchor when said line is pulled from said storage area, to prevent said bitter end from slipping into said container, and to prevent said line from being released through said aperture; and a marine anchor secured to said anchor end of said anchor line, said anchor being at least partially inserted into said storage area through said opening in said second end, and means for engaging said anchor to secure the same in said container for storage.

13. Storage, transportation, and dispensing apparatus for a marine anchor and anchor line comprising in combination:

an anchor line having an anchor end section adapted to be secured to a marine anchor and a bitter end section adapted to be secured to a vessel;

a container for receiving said anchor line;

said container including side walls defining a storage area therewithin receiving at least a portion of said line for storage therein and first and second generally opposing ends, said first end being generally closed and having an aperture therethrough, said aperture receiving therethrough said bitter end section of said anchor line to attach said apparatus to a vessel, said second end including an opening to said storage area receiving said anchor end section of said anchor line therethrough;

means for closing said opening at said second end including release means at said opening engaging said anchor line for restraining and controlling release of said anchor line from said storage area to prevent a large bundle of said line from being released en masse when said line is pulled outwardly from said container;

securing means for holding said container in a predetermined position along said anchor line to prevent said container from moving with the anchor line and any anchor when said line is pulled from said storage area, to prevent said bitter end from slipping into said container, and to prevent said line from being released through said aperture; said securing means including a strap affixed to the inside of said container, said strap being tied to said anchor line.

14. Storage, transportation, and dispensing apparatus for a marine anchor and anchor line comprising in combination:

an anchor line having an anchor end section adapted to be secured to a marine anchor and a bitter end section adapted to be secured to a vessel;

a container for receiving said anchor line;

said container including side walls defining a storage area therewithin receiving at least a portion of said line for storage therein and first and second generally opposing ends, said first end being generally closed and having an aperture therethrough, said aperture receiving therethrough said bitter end section of said anchor line to attach said apparatus to a vessel, said second end including an opening to said storage area receiving said anchor end section of said anchor line therethrough;

means for closing said opening at said second end including release means at said opening engaging said anchor line for restraining and controlling release of said anchor line from said storage area to prevent a large bundle of said line from being released en masse when said line is pulled outwardly from said container;

securing means for holding said container in a predetermined position along said anchor line to prevent said container from moving with the anchor line and any anchor when said line is pulled from said storage area, to prevent said bitter end from slipping into said container, and to prevent said line from being released through said aperture; and drainage means at one portion of said side walls for draining water or other liquids from said storage area, and a handle secured to another portion of said side walls generally opposite said one portion whereby when said apparatus is carried with said handle, said drainage area will face downwardly.

15. A container for storing, transporting, and dispensing a marine anchor and an anchor line therefor comprising side walls defining a storage area therewithin and first and second generally opposing ends, said first end being generally closed and including an aperture therethrough to said storage area for receiving one end of said anchor line therethrough to secure said container to a vessel by means of the one end of the line, said second end including an opening to said storage area for receiving the opposite end of the anchor line therethrough; said storage area adapted to receive the intermediate sections of the said anchor line; release means at said second end opening for engaging the anchor line when received therethrough and restraining and controlling release of the anchor line from said storage area, said release means including means for changing the size of said second end opening to prevent the line from being released all at one time when pulled outwardly from said container; securing means for holding said container in a predetermined position along the anchor line to prevent said container from moving along any anchor line toward its anchor end when the line is released and pulled from said storage area; and drainage and ventilation means for draining water from said storage area for allowing air circulation to said storage area of said container for drying any anchor line therein.

16. The container of claim 15 including a handle, said handle being positioned on said container generally opposite said drainage means for carrying said container with said drainage means facing down.

17. A container for storing, transporting, and dispensing a marine anchor and an anchor line therefor comprising side walls defining a storage area therewithin and first and second generally opposing ends, said first end being generally closed and including an aperture therethrough to said storage area for receiving one end of said anchor line therethrough to secure said container to a vessel by means of the one end of the line, said second end including an opening to said storage area for receiving the opposite end of the anchor line therethrough; said storage area adapted to receive the intermediate sections of the said anchor line; means for closing said opening at said second end including release means at said opening for engaging the anchor line when received therethrough and restraining and controlling release of the anchor line from said storage area to prevent the line from being released all at one time when pulled outwardly from said container; securing means for holding said container in a predetermined position along the anchor line when the line is pulled from said storage area; drainage means for draining water from said storage area; a handle, said handle being positioned on said container generally opposite said drainage means for carrying said container with said drainage means facing down; said release means including flexible portions of said side walls adjacent and extending around said opening and drawing means for drawing said flexible side wall portions together around said anchor line to engage said anchor line for controlled release thereof.

18. The apparatus of claim 17 wherein said securing means includes a strap affixed to the inside of said container, said strap being tied to said anchor line.

19. A method for storing an anchor line for marine anchors with a container having a pair of ends, an aperture in one end and an opening for inserting and removing said anchor line from the container at the other end; said method comprising:

1. projecting one end of said anchor line through said aperture in said one end for securing said container and line to a vessel with said anchor line;
2. affixing a securing means to at least one of said container and line to restrain said container at a predetermined location on said line to prevent said container from moving with said line when said line is released through said opening;
3. arranging at least an intermediate portion of said anchor line in said container by inserting said intermediate line portion into said container; and
4. projecting the other end of said anchor line through said opening at said other container end for attachment to a marine anchor.

20. The method of claim 19 further comprising dispensing said stored anchor line from said container by controlling release of said line through said opening at said other container end with a control means at said opening.

21. The method of claim 20 including securing said container and anchor line to a vessel with said one end of said anchor line projected through said aperture in said one container end.

22. The method of claim 19 including storing at least a portion of an anchor in said container by inserting said anchor portion into said container through said opening at said other container end and securing said container to a portion of said anchor.

23. The method of claim 19 including draining and ventilating said container with a drainage and ventilation means therein when water or other liquids are collected within said container.

24. The method of claim 23 including transporting said container and anchor line by carrying said container from a portion thereof opposite said drainage means such that said drainage means faces downwardly.

25. A method for storing an anchor line for marine anchors with a container having a pair of ends, an aperture in one end and an opening for inserting and removing said anchor line from the container at the other end, and flexible side walls at said opening; said method comprising:

1. projecting one end of said anchor line through said aperture in said one end for securing said container and line to a vessel with said anchor line;
2. arranging at least an intermediate portion of said anchor line in said container by inserting said intermediate line portion into said container;
3. projecting the other end of said anchor line through said opening at said other container end for attachment to a marine anchor; and
4. dispensing said stored anchor line from said container by controlling release of said line through said opening at said other container end with a control means at said opening by closing said flexible side walls about said line as it is pulled from said container.

26. A method for securing and storing an anchor line and any marine anchor attached to said anchor line on a vessel comprising:

1. storing an anchor line in a container having a storage area, an aperture in one end and a removal opening in its opposite end by projecting one end of said anchor line through said aperture in said one container end and arranging other portions of said anchor line in said container storage area; and
2. securing said container along the portion of said anchor line which is projected through said aperture to prevent movement of said container toward the end of said anchor line including any anchor thereon; and
3. attaching said container including the stored line and any anchor thereon to a vessel with said one end of said line which extends from said aperture.

27. The method of claim 26 further including dispensing said anchor line and any anchor thereon without attendance by an operator including releasing said line from said container in a controlled manner by engaging said line as it is withdrawn from said removal opening with a line control means at said removal opening.

28. A method for securing and storing an anchor line and any marine anchor attached to said anchor line on a vessel comprising:

1. storing an anchor line in a container having a storage area, an aperture in one end and a removal opening in its opposite end by projecting one end of said anchor line through said aperture in said one container end and arranging other portions of said anchor line in said container storage area;
2. securing said container along the portion of said anchor line which is projected through said aperture to prevent movement of said container toward the end of said anchor line including any anchor thereon;
3. attaching said container including the stored line and any anchor thereon to a vessel with said one end of said line which extends from said aperture; and
4. dispensing said anchor line and any anchor thereon without attendance by an operator including releasing said line from said container in a controlled manner by engaging said line as it is withdrawn from said removal opening with a line control means at said removal opening by drawing flexible portions of said container adjacent said opening around said line to engage said line, prevent passage of the entire amount of said stored line through said removal opening at one time, and reduce snarls and tangles in said line as it is released.

* * * * *

UNITED STATES PATENT AND TRADEMARK OFFICE

CERTIFICATE OF CORRECTION

PATENT NO. : 3,977,448

DATED : August 31, 1976

INVENTOR(S) : Donald P. Botting

It is certified that error appears in the above-identified patent and that said Letters Patent are hereby corrected as shown below:

Column 2, line 17;

"mens" should be --means--;

Column 6, line 2;

"is" should be --in--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*